US008035019B2

(12) United States Patent
Cadd

(10) Patent No.: US 8,035,019 B2
(45) Date of Patent: Oct. 11, 2011

(54) WEARABLE INSTRUMENT SUPPORTING MEANS

(76) Inventor: John J. P. Cadd, Ellesmere Port (GB)

( * ) Notice: Subject to any disclaimer, the term of this patent is extended or adjusted under 35 U.S.C. 154(b) by 0 days.

(21) Appl. No.: 12/487,244

(22) Filed: Jun. 18, 2009

(65) Prior Publication Data

US 2010/0319515 A1 Dec. 23, 2010

(30) Foreign Application Priority Data

Jun. 19, 2008 (GB) ..... 0811218.7

(51) Int. Cl.
*G10G 3/00* (2006.01)

(52) U.S. Cl. ..... 84/453

(58) Field of Classification Search ..... 84/421, 84/453

See application file for complete search history.

(56) References Cited

U.S. PATENT DOCUMENTS

| | | | | |
|---|---|---|---|---|
| 3,979,993 | A | 9/1976 | Proctor | |
| 4,310,111 | A | 1/1982 | Brent | |
| 5,000,071 | A | 3/1991 | Thomas | |
| 6,040,509 | A * | 3/2000 | Fanella | 84/280 |
| 2005/0183564 | A1 | 8/2005 | Ripley | |
| 2007/0289430 | A1 | 12/2007 | Gallagher | |

FOREIGN PATENT DOCUMENTS

| | | | | |
|---|---|---|---|---|
| DE | 202006019400 U1 * | 4/2007 | | 84/273 |
| DE | 10 2005 018 236 B4 | 6/2007 | | |

* cited by examiner

*Primary Examiner* — Kimberly R Lockett

(74) *Attorney, Agent, or Firm* — Thorpe North & Western LLP

(57) ABSTRACT

A wearable instrument supporting means comprising: an instrument mountable support (10) having a surface (11); and a wearable support (1) having at least one region (4) that has a non-slip relationship with said surface (11) of the instrument mountable support (10); and wherein said at least one region (4) is positioned to contactably align with the surface (11) of the instrument mountable support (10) when the instrument (15) is in normal use.

12 Claims, 5 Drawing Sheets

WEARABLE INSTRUMENT SUPPORTING MEANS

FIELD OF THE INVENTION

The present invention relates to an instrument support that can be worn by the user to help hold an instrument during use, and in particular instrument supports that are used for musical instruments such as violins and violas.

BACKGROUND OF THE INVENTION

Certain musical instruments, such as violins and violas, are played from a position under the chin of the musician. The ideal points of contact to hold a violin are the left-hand, chin and collarbone. A problem arises with the collarbone contact because the edge of the violin is generally at an angle of about 45° to the collarbone and there is precious little to cushion this contact. This positioning can cause the player some discomfort.

To address this problem most players fit a padded shoulder rest which generally sits further away from the collarbone on the shoulder itself.

Whilst this arrangement can seem more comfortable during play, unfortunately it gives rise to a serious problem of shoulder tensions caused by an automatic clamping-down of chin and hunching-up of shoulder.

Even when padded shoulder rests are used there is a sense that the instrument may slip and fall, particularly when the player is shifting hand position and using vibrato which has a tendency to destabilise an already awkward situation.

This process of clamping tension can persist so that advanced students show up at Music College to start a formal training with all sorts of painful neck, jaw and spinal problems, which have to be sorted out first. The situation is bad enough to force some players to stop playing completely. These problems have been well documented in medical books over a number of years.

The paradox of this situation is that the more comfortable the shoulder rest is, the more it restricts actual playing. The shoulder is obstructed by the clumsy shape of the shoulder rest when reaching for high notes. There is an added danger in that many players fit the shoulder rest at the wrong angle which leads into problems of leverage against the jaw and twisting of the neck. This all leads onto a set of very painful debilitating conditions.

There is a need for an alternative support rest that facilitates more comfortable playing without causing the numerous painful reactions which are so prevalent.

SUMMARY OF THE INVENTION

The present invention provides a wearable instrument supporting means comprising: an instrument mountable support having a surface; and a wearable support having at least one region that has a non-slip relationship with said surface of the instrument mountable support; and wherein said at least one region is positioned to contactably align with the non-slip surface of the instrument mountable support when the instrument is in normal use.

Preferably, the non-slip relationship between the surface of the instrument mountable support and the at least one region of the wearable support is due to an interaction selected from the group containing frictional, magnetic and mechanical.

Further preferably the continuous non-slip relationship is provided by a frictional interaction between a frictional material on either the surface of the instrument mountable support, the at least one region of the wearable support, or both.

Preferably the wearable support comprises a neck retaining means to enable the article to be worn loosely around the neck of a user. Further preferably the neck retaining means of the wearable support incorporates within it a thin non-stretchable material. In this way any pulling forces applied to the body of the wearable support will be counteracted, thus maintaining a stable position for the instrument when in use.

Advantageously the neck retaining means comprise at least one turn-up portion to prevent the at least one region of the wearable support from being obstructed by the user's clothing. It also gives support to the curved portion of the instrument supportable means.

Preferably the wearable support further comprises a region of non-slip material that is positioned to contactably align with the user or the user's clothing when the instrument is in normal use. The position of a non-slip region on the underside of the wearable support helps retain the position of the support relative to the user.

Further preferably, and for ladies with shoulderless dresses, holes are provided around the wearable support, preferably in the vicinity of the edges, which enable the attachment of a layer made out of cotton or other suitable material which can absorb any perspiration.

Alternatively the wearable support comprises a garment of clothing with a non-slip region located at an appropriate position thereon. The non-slip region may be provided by a piece of material that is removably attached to the clothing, for example using hook and loop materials.

Advantageously, the wearable support further comprises a protective insert, said protective insert being positioned below the at least one region of the wearable support to accept the chin pressure immediately above the collarbone when the instrument is in normal use. Alternatively or additionally the instrument mounting support may comprise a protective insert.

Further preferably the wearable support means has a shape that is complimentary to the static unmoving shoulder area of the user.

Preferably the instrument mountable support means comprises mounting means adapted to mount the support means on the chin rest clamp of a chin engaging instrument, such as a violin or viola. Alternatively the mounting means may be adapted to mount the support means directly on to the chin engaging instrument.

It is also considered advantageous for the instrument mountable support means comprises a flexible central portion and flexible end portions, wherein the end portions are more flexible than the central portion to facilitate tilting of the chin engaging instrument in normal use. Also when the instrument is placed in its case the instrument mountable support means will fold against the back of the instrument and thus avoid causing damage when the case is closed. Further preferably the flexible portions of the instrument mountable support are made from plastic.

Preferably the instrument mountable support means further comprises, in association with the plastic, a thin springy piece of cable wire which compliments the plastic memory properties of the plastic material to achieve the best angle for contact of the friction surfaces and improves the speed of reaction of this arrangement.

In an alternative embodiment of the instrument mountable support said support comprises a mounting element being is attachable to the instrument, a surface carrying element being provided with the surface that contacts the wearable support, and a connecting element that connects the mounting element to the surface carrying element such that the surface carrying element can move relative to the mounting element.

Preferably the connecting element attaches to the surface carrying element at a point away from the end of the surface carrying element. Further preferably the surface carrying element is contoured to provide a more comfortable fit for the user when the instrument is in use.

Advantageously the mounting means are arranged such that the surface of the instrument mountable support means projects from the instrument back at an angle of between 20° to 45°. Preferably the mounting means itself is bent to form the angle of 135°.

Other preferable features of the present invention will be appreciated from the embodiments described, with reference to the figures, below.

BRIEF DESCRIPTION OF THE DRAWINGS

In the drawings, which illustrate exemplary, non-limiting embodiments of the invention.

DETAILED DESCRIPTION OF THE INVENTION

The present invention provides a wearable instrument support means that is primarily intended for use by musicians who play fiddles, violins and violas. However it is to be appreciated that the general concept of the present invention may be applied to other non-musical instruments and tools that are mounted on the body of the user during their operation. Due to the necessarily awkward playing position adopted for such instruments the support of the present invention can be of great benefit to musicians.

During normal use it is sometimes necessary for the musician to clamp the violin in position by applying pressure with the chin, for example when changing position on the fingerboard. Maintaining this type of pressure can become painful for the musician over an extended playing period.

By combining a high friction surface and a wide protective area over the collarbone to accept chin pressure the discomfort is removed and it is no longer necessary to use the shoulder muscles or to grip tightly with the chin.

The wearable instrument support means of the present invention provides a comfortable playing experience over extended periods of play and a classic healthy playing posture without a traditional shoulder rest.

The support means of the present invention comprise two parts, the first part is worn on the body of the musician and the second part is mounted on the musical instrument. Both parts are provided with a surface, said surfaces being made from materials that have a non-slip relationship with one another. Thus the support means enables the user to mount an instrument during playing.

Figure 1:
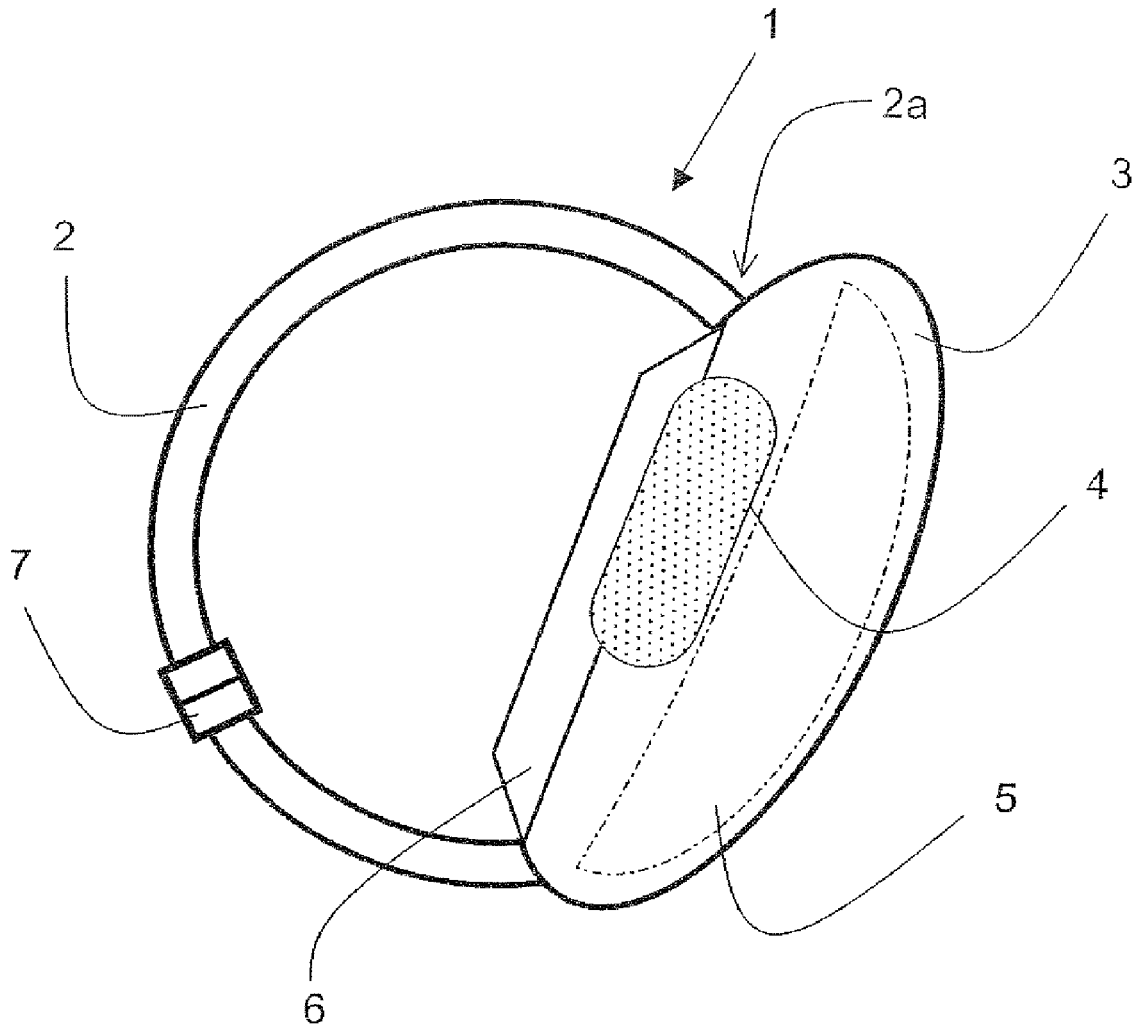
FIG. 1 shows a preferred embodiment of the wearable support of the present invention.

FIG. 1 shows a preferred embodiment of the first part of the wearable instrument support means, which is a wearable support designed to be worn loosely around the neck of the musician. However it is to be appreciated that the support means could be worn in another manner e.g. by incorporation into the musician's clothing.

The wearable support 1 comprises a neck strap 2 that enables the musician to wear the support 1 around their neck. Preferably the neck strap 2 has a releasable clip means 7 that enables the neck strap 2 to be clipped around the musician's neck rather than placed over the musician's head. It is to be appreciated that the neck strap 2 may be adjustable to suit the size of the musician using the wearable support 1.

Preferably the neck strap will be such that it can be tucked inside the musician's jacket. Advantageously the neck strap 2 can be made in any colour to match the player's clothing.

It is to be appreciated that the neck strap 2 will preferably have enclosed within it a layer of material which will resist stretching while the outer material (e.g. leatherette) will have a more pliable cushioning quality against the player's neck.

The neck strap 2 is attached to the main body 3 of the wearable support 1 at two points. The attachment of one end of the neck strap 2*a* is offset so as to enable the neck strap 2 to be tucked inside the musician's jacket without obstructing the main body of the wearable support 1. The exact nature of the offset position could be adjusted to suit the player.

The main body 3 is provided with a surface 4 which is made from a material that has the required non-slip relationship with the corresponding surface 11 on the second part of the support means, i.e. the instrument mounted support 10 (as shown in FIGS. 2 to 5).

The non-slip relationship between the surfaces 4, 11 of the two components of the present invention will be discussed in more detail below.

The surface 4 preferably covers at least a portion of the main body 3. Whilst the surface 4 should preferably be no greater in size to the corresponding surface 11, it is to be appreciated that it could be smaller in size. In this way the amount of frictional material facing the varnished surface of the instrument can be minimised. Having a surface 4 that is roughly the same size as the corresponding surface 11 has the additional benefit of providing guidance to beginners on where to position the instrument during use.

The area of body 3 which is not covered by the friction surface 4 is mainly provided to form a wide platform which enhances the overall stability of body 3. The underside of body 3 also has an area of frictional material which will engage with the musician's clothing whilst the area of the underside near the shirt or blouse collar of the player is left free of friction material to avoid any rucking up of the collar. This also avoids interference with the frictional relationship between surfaces 4 and 11, for example, in the event that a part of the player's clothing, such as their shirt or blouse collar slips between the surfaces 4 and 11.

Although not shown in FIG. 1, it is to be appreciated that the area of surface on the underside of the wearable support 1 may be covered by a detachable layer of absorbent material, e.g. cotton cloth for mainly female players who wear shoulderless dresses. In this regard, attachment may be effected by way of a number of holes provided on the wearable support 1, preferably around the edges or periphery thereof.

It will be appreciated that the non-slip surface 4 may alternatively be applied to the main body 3 in a range of different patterns and not just in a continuous panel.

An important feature of the frictional relationship between surface 4 on the wearable support 1 and the surface 11 on the instrument mountable support 10 is that the tendency of the wearable support to move out of its preferred position is strongly resisted by the gripping effect of surfaces 4 and 11, as these two surfaces make any lateral rotating movement against one another very unlikely.

Those skilled in the art will appreciate the silent instant grip provided between surfaces 4 and 11 and also the instant silent release afforded when the all pressure is released.

Advantageously, even when the chin pressure is released completely the passive weight of the instrument lightly resting on the body 3 is quite sufficient to maintain lateral grip.

The main body 3 is preferably constructed from a plate of resilient material 5, such as metal or plastic sandwiched between two layers of a hard wearing but pliable material, such as leatherette. The plate 5, which is preferably bent by hand to suit the general shape of the musician's inner shoulder/chest area, provides a structural strength to the wearable support 1. The plate 5 also provides a level of protection to the collarbone of the musician during use of the instrument. Another important feature of plate 5 is that any pulling forces which would tend to disrupt the shape of body 3 are strongly resisted by plate 5 and further that the pulling forces are transferred directly to the neck strap 2 thus maintaining the body 3 in its ideal position during playing.

It is to be appreciated that a wide range of materials will be suitable to construct the main body 3 of the wearable support 1.

The area of body 3 of the wearable instrument supporting means at the lowest point 8 is shaped so that the player can use one finger of the bow hand to centralise the wearable support 1 just before placing the instrument under his/her chin. It is to be appreciated that a fixing cord 9 or elastic material could be attached to the lowest point 8 of body 3 to ensure its correct position by attaching said fixing to the players clothing.

The main body 3 further comprises a flap portion 6 which is positioned so that, in use, the flap portion 6 prevents the collar of the musician's shirt or blouse from riding up over the wearable support 1 and obstructing the 'Non-slip' surface 4. Although not shown, it is appreciated that the neck strap 2 may also be provided with a similar flap portion, to control the other collar on the opposite side of the musician's neck.

The plate 5 also provides a gently curved surface which aids the player in tilting the instrument to a more horizontal position for high notes and also a more vertical position for low notes.

Figure 2:
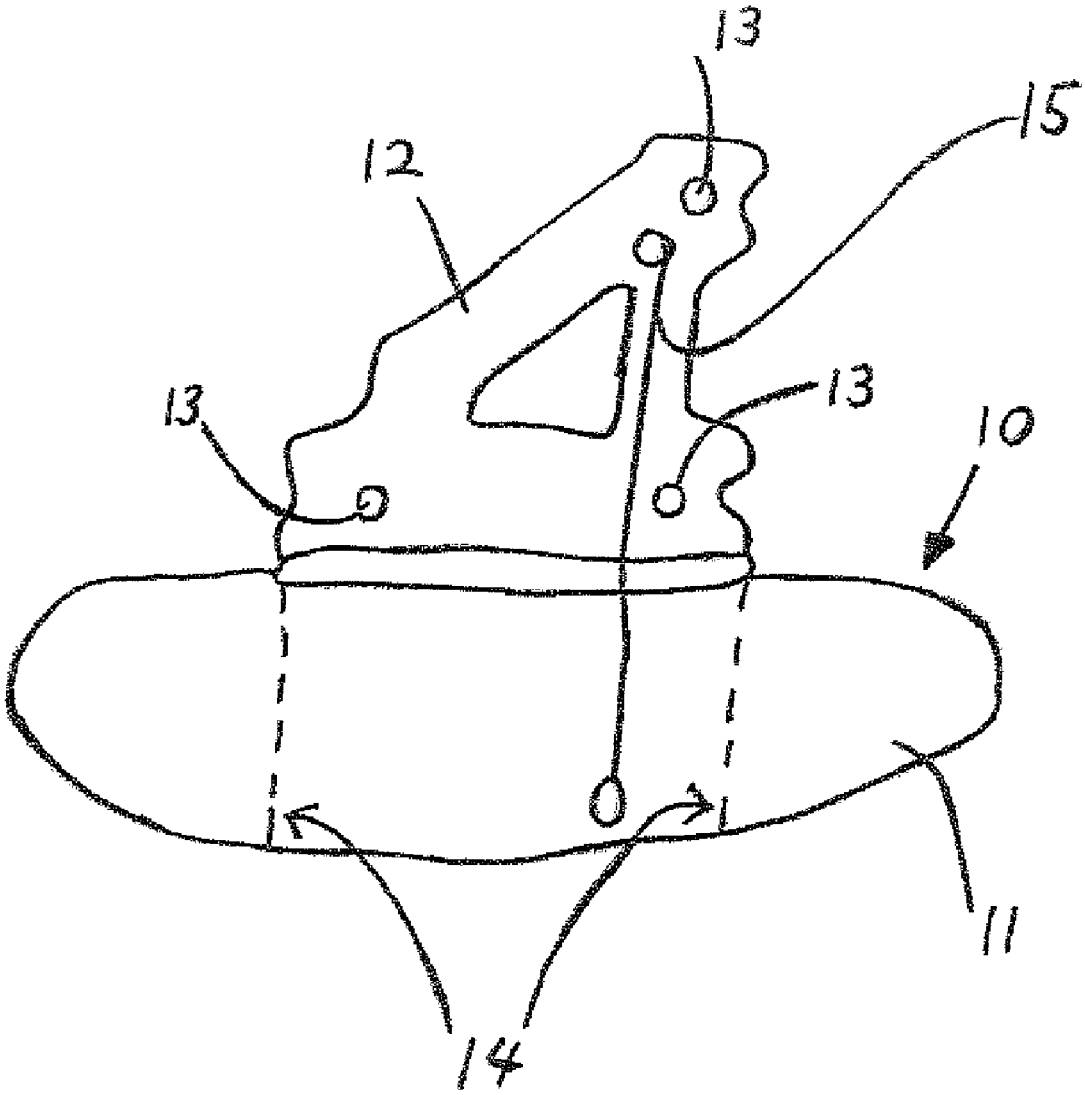
FIG. 2 shows a preferred embodiment of the instrument mountable support of the present invention.

FIG. 2 shows a preferred embodiment of the second part of the present invention, the instrument mountable support 10. The instrument support 10 is preferably made from layers of flexible material such as HDPE plastic, which has an innate flexibility. By fusing together various layers it is possible to produce a mixture of qualities of stiffness and varied flexibility depending on the particular patterns of fusion points.

The flexible material of the area 11 may be covered in a soft pliable material, such as chamois leather or the like, which would not damage the varnish of the instrument.

The support 10 has two main parts, the musician engaging means, which is preferably about 10 cm long and comprises the 'non-slip' surface 11, and the instrument mounting means 12.

In addition to the flexibility between the musician engaging means, with surface 11, and the mounting means 12, the musician engaging means further comprises flexible areas at either end of the surface 11 as indicated by lines 14. The shape and attachment points will allow the surface 11 to flex in another direction substantially at about 90° to the main flexing angle where the mounting means 12 joins the surface 11.

This combination of flexing directions of surface 11 will allow for tilting of the instrument whilst maintaining frictional contact between surface 11 on the instrument mounting support 10 and area 4 on the wearable support 1.

The flexible nature of the support 10 will also prevent any potentially damaging leverage being applied to the chinrest 16 during use. It will also make possible the safe fitting of the instrument into its case without damage when the lid is closed. It will be appreciated that alternative means for providing flexible ends to the musician engaging means are possible.

Figure 3:
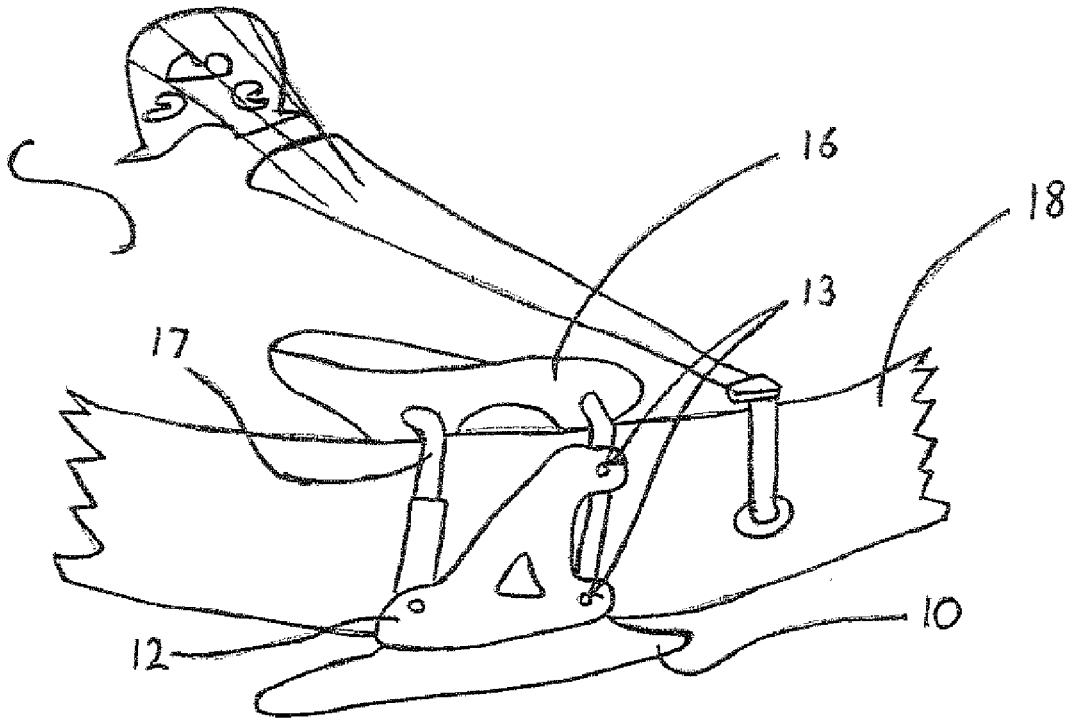
FIGS. 3 to 5 show various views of the instrument mountable support of FIG. 2 mounted on an instrument.
Figure 4:
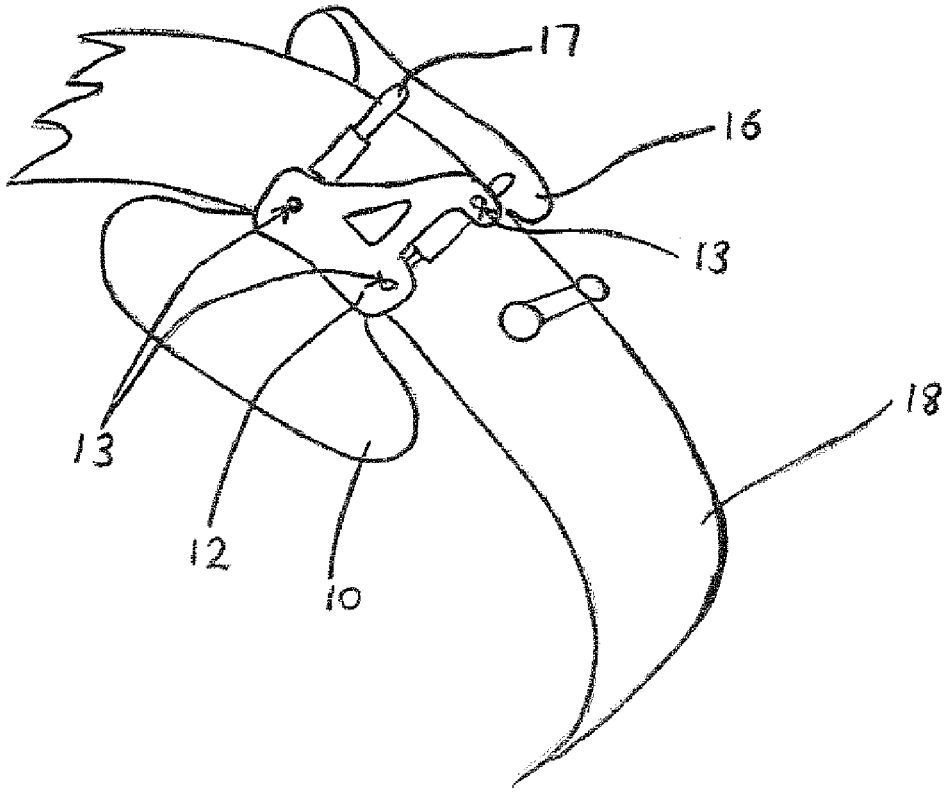
Figure 5:
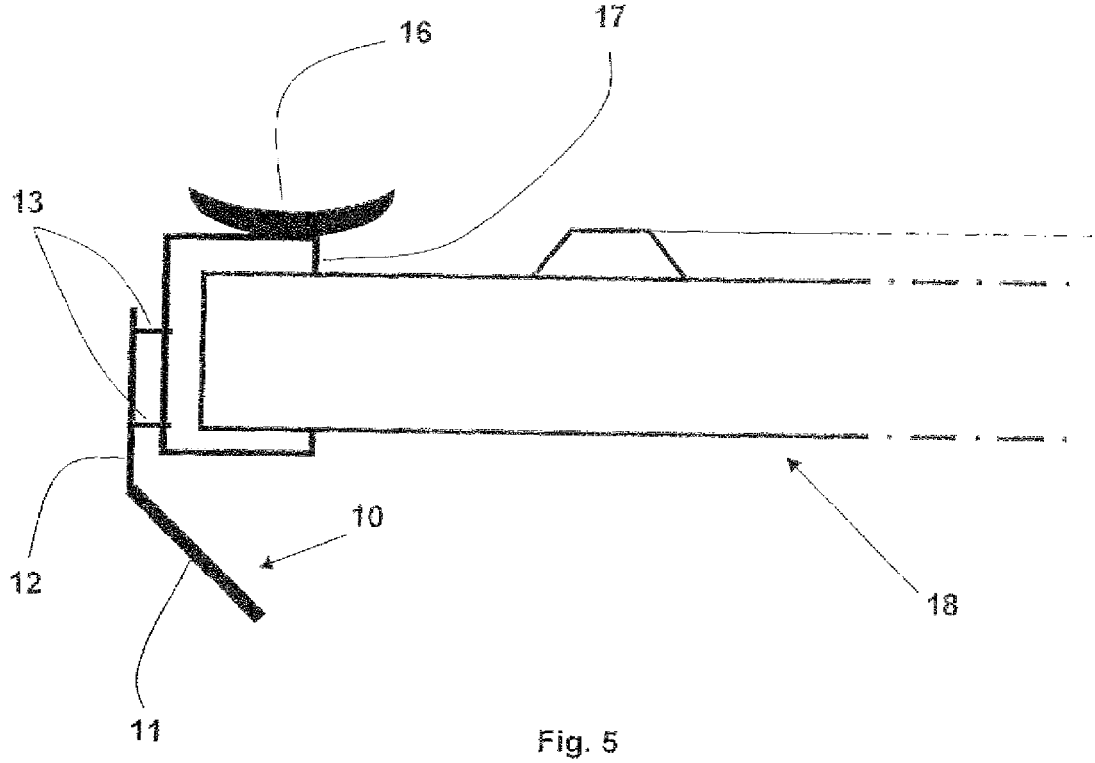

FIGS. 3 to 5 show the instrument mounted support 10 attached to a violin 18. The mounting means 12 is, in the preferred embodiment, mountable to an instrument 18 via the instrument's chinrest adjusters by using loops that pass through the holes 13 and around the mounting means 17 of the chinrest 16. It is to be appreciated that alternative methods of fixing the support 10 to an instrument, both directly and indirectly, are possible.

The shape of the musician engaging means of the instrument mounted support 10 will preferably be designed to accommodate the general shape of the static part of the musician's inner shoulder area so as to maximise the comfortable use of the instrument.

Shaping the wearable support to avoid contact with the more mobile areas of the players shoulder, in particular their shoulder muscles, will also aid smooth bowing, as the bow will not be disturbed by unsettling movements passed through the instrument.

The support 10 is shaped such that areas are cut away to provide access to the chinrest adjusters so that the player is not prevented from making any necessary adjustments to the chinrest by the instrument mountable support 10.

It is appreciated that the support 10 could be made in a variety of shapes to accommodate various types of chinrest clamp and also to avoid obstruction by the end pin which protrudes from the end of the instrument.

As can be seen from FIG. 5, the musician engaging means, with surface 11 and the mounting means 12 are formed at an angle of between 120-150° and preferably 135° to one another. In this way the mounting means can be attached relative to the instrument at one orientation whilst the surface 11 of the musician engaging means is orientated in the most comfortable position for the musician.

It will be appreciated that the springy flexible nature of the support 10, and optionally and additionally the spring wire 15, will ensure continuous contact between the non-slip surfaces 4 and 11 at varied instrument positions and angles and will provide a great level of confidence to the player.

Figure 6:
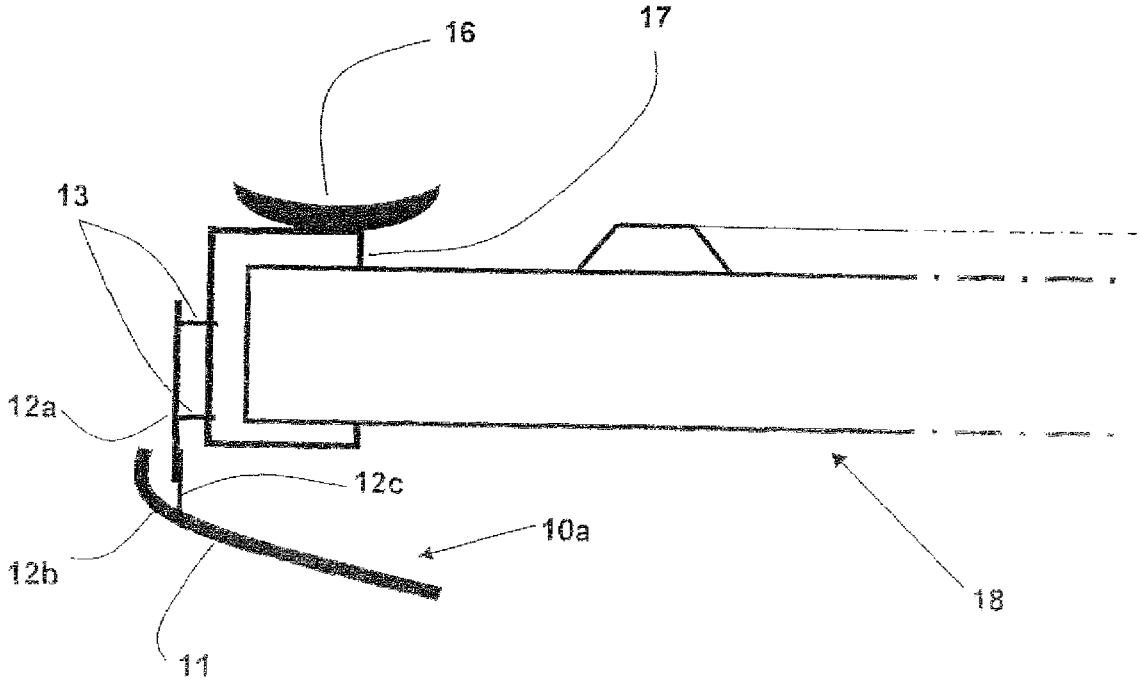
FIG. 6 shows an alternative embodiment of the instrument mountable support of the present invention mounted on an instrument.

An alternative embodiment of the instrument mountable support 10*a* of the present invention is shown in FIG. 6. By comparison to the support 10 of FIG. 5, the support 10*a* of FIG. 6 includes a surface 11 an end of which 12*b* extends beyond the hinge connection 12*c* between the mounting means 12*a* and surface 11. As shown, the curved end portion 12*c* is curved and shaped to correspond to and complement the curved surface provided by the flap portion 6 on the main body 3. One advantage of this embodiment is that it maximises the area of contact between the respective non-slip surfaces provided by both the instrument and wearable supports and hence, reduces wear and tear. It will also be appreciated that the contoured edge or curvature of the surface 12*b* will provide a more comfortable fit for the musician during use. A further advantage of the embodiment shown in FIG. 6 is that the surface 11 itself is not subjected to constant flexing, which over time can cause damage to surface 11 that is made from materials such as rubber for example. It also makes it easier to cover the surface 11 with a suitable backing or non-slip backing material.

Figure 7:
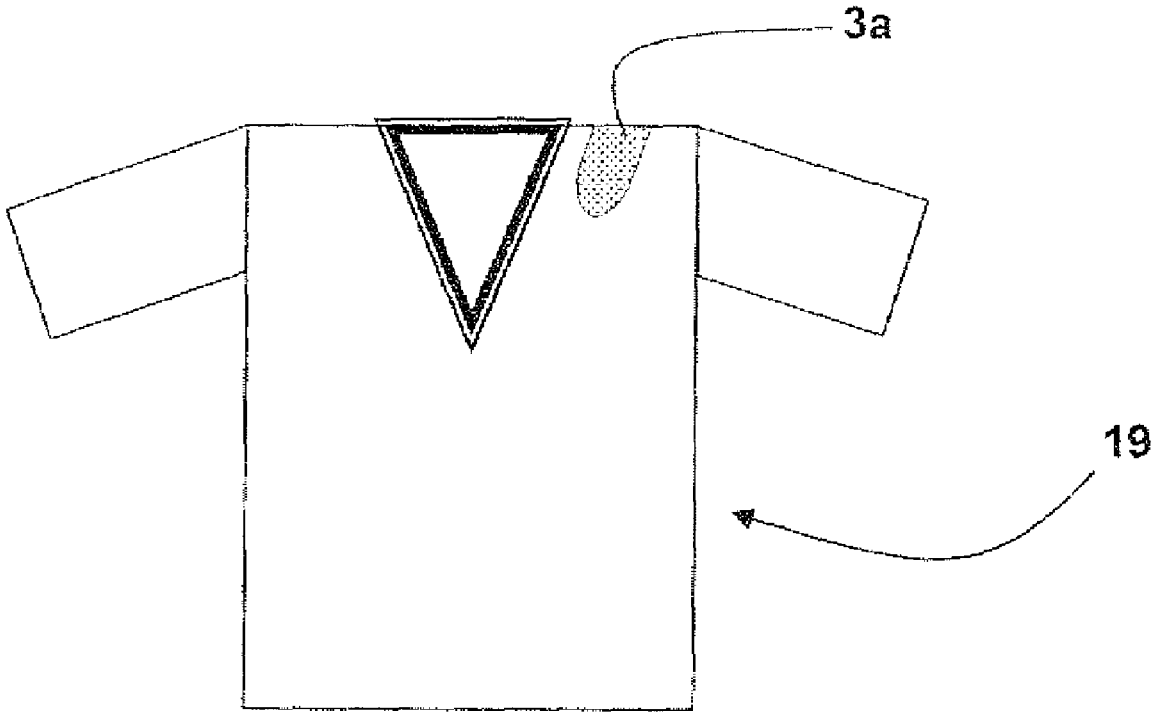
FIG. 7 shows an alternative embodiment of the wearable support of the present invention.

FIG. 7 shows an alternative embodiment of the wearable support of the present invention. The wearable support 19 is a garment of clothing, such as a shirt or jacket, which can be worn by a musician when playing their instrument. The wearable support 19 is provided with a non-slip surface 4*a*. It will be appreciated that the surface 4*a* is located on the garment in a position suitable for engaging the instrument mountable support during use of the instrument. The area of the garment could also be reinforced, such as with padding.

One of the most important elements of the present invention is the non-slip relationship between corresponding surfaces 4 (or 4*a*) and 11 on the wearable support 1 (or 19) and the instrument mountable support 10 respectively. This non-slip relationship can be provided by various means, examples of which include frictional interaction, magnetic interaction and mechanical interaction.

A typical example of a mechanical interaction might be the use of hook and loop materials (e.g. Velcro®). It is appreciated that one of the surfaces 4 or 11 could be provided as the hook material and the other as the loop material. Alternative forms of mechanical interaction will be appreciated by the skilled person.

A magnetic interaction between the wearable support 1 and the instrument mountable support 10 could be achieved by providing one of the surfaces 4 or 11 with a magnetic characteristic. It is appreciated that if the surface 11 is provided as a magnetic material it could interact with a plate 5 made of metal.

However the preferred form of non-slip relationship used for the present invention is from friction between the two surfaces 4 and 11. Various materials having high frictional characteristic could be suitably used for the present invention and it is appreciated that a non-slip relationship can be achieved without using a high friction material on both surfaces 4 and 11.

A further improvement of the present invention would be possible if the non-slip relationship between surfaces 4 and 11 is instantly attachable and detachable without any sound or noise. In this regard, a preferred form of high friction material is rubber; although the skilled person will appreciate that alternative high friction materials may also be used.

Another advantage of the present invention is that the materials providing the non-slip surfaces can be readily removable and replaced as and when the need arises. In this regard, in one aspect, they can be simply glued to the respective part of the support and readily replaced as and when the need arises.

It will be appreciated that the features of the embodiments described above are not intended to be limiting on the scope of the claims, and that any combination of the features described is appreciated to be possible without deviating from the general teaching of the invention as defined in the claims.

Whilst the wearable instrument support of the present invention is primarily designed for use with musical instruments, it is appreciated that the support could be used to support other instruments that are mounted on the user's body during use e.g. telephones, or even as a substitute for clothing attachments, e.g. zips or buttons or even quick release panels on football shirts to reduce shirt pulling (combine with weak plastic snap fasteners).

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A wearable instrument supporting means for an instrument that is engaged by a user's chin in normal use, said supporting means comprising:

an instrument mountable support having a surface; and a wearable support having at least one region that has a non-slip relationship with said surface of the instrument mountable support; and wherein said at least one region is positioned to contactably align with the surface of the instrument mountable support when the instrument is in normal use; wherein the wearable support further comprises a protective insert, said protective insert being positioned below the at least one region of material.

2. The wearable instrument supporting means of claim 1, wherein the non-slip relationship between the surface of the instrument mountable support and the at least one region of the wearable support is due to an interaction selected from the group containing: frictional, magnetic and mechanical.

3. The wearable instrument supporting means of claim 1, wherein the non-slip relationship is provided by a frictional interaction between a frictional material on either the surface of the instrument mountable support, the at least one region of the wearable support, or both.

4. The wearable instrument support means of claim 3, wherein the frictional relationship is silent and instant in attachment and also in detachment.

5. The wearable instrument supporting means of claim 1, wherein the wearable support comprises a non-stretch neck retaining means to enable the article to be worn around the neck of a user.

6. The wearable instrument supporting means of claim 5, wherein the neck retaining means comprise at least one turn-up portion to prevent the at least one region from being obstructed by the user's clothing.

7. The wearable instrument supporting means of claim 1, wherein the wearable support further comprises a region of non-slip material that is positioned to contactably align with the user or the user's clothing when the instrument is in normal use.

8. The wearable instrument supporting means of claim 1, wherein the wearable support means has a shape that is complementary to the area of the user's collarbone which is static during use of the instrument.

9. The wearable instrument supporting means of claim 1, wherein the instrument mountable support means comprises mounting means adapted to mount the support means on the chinrest of a chin engaging instrument.

10. The wearable instrument supporting means of claim 9, wherein the instrument mountable support means comprises a flexible central portion and flexible end portions, wherein the end portions are more flexible than the central portion to facilitate tilting of the chin engaging instrument and to ensure continuous contact of the friction surfaces in normal use.

11. The wearable instrument supporting means of claim 9, wherein the mounting means are arranged such that the instrument mountable support means project from the plane of the instrument back at an angle of about 45° and at an angle of about 135°, from the chin rest.

12. The wearable instrument supporting means of claim 9, wherein the instrument mountable support comprises a mounting element being is attachable to the instrument, a surface carrying element being provided with the surface that contacts the wearable support, and a connecting element that connects the mounting element to the surface carrying element such that the surface carrying element can move relative to the mounting element.

* * * * *